US006747234B2

(12) United States Patent
Traska et al.

(10) Patent No.: US 6,747,234 B2
(45) Date of Patent: Jun. 8, 2004

(54) HIGH VOLTAGE INTERRUPTER

(75) Inventors: Robert A. Traska, Cedarburg, WI (US); William M. Hurst, Whitefish Bay, WI (US)

(73) Assignee: Maysteel LLC, Menomonee Falls, WI (US)

( * ) Notice: Subject to any disclaimer, the term of this patent is extended or adjusted under 35 U.S.C. 154(b) by 0 days.

(21) Appl. No.: 10/202,295

(22) Filed: Jul. 23, 2002

(65) Prior Publication Data

US 2004/0016721 A1 Jan. 29, 2004

(51) Int. Cl.[7] ..... H01H 33/66
(52) U.S. Cl. ..... 218/134; 218/139; 218/140
(58) Field of Search ..... 218/118–143, 155, 218/154, 10

(56) References Cited

U.S. PATENT DOCUMENTS

| | | | | |
|---|---|---|---|---|
| 3,812,314 A | | 5/1974 | Nonken | 200/144 B |
| 3,955,167 A | | 5/1976 | Kumbera | 337/188 |
| 4,124,790 A | | 11/1978 | Kumbera et al. | 200/144 B |
| 4,130,781 A | * | 12/1978 | Dethlefsen | 218/135 |
| 4,429,197 A | | 1/1984 | Sakuma et al. | |
| 4,568,804 A | | 2/1986 | Luehring | 200/144 B |
| 4,618,749 A | | 10/1986 | Böhme et al. | 200/144 B |
| 4,879,441 A | | 11/1989 | Hamm et al. | 200/144 B |
| 4,880,947 A | | 11/1989 | Fey et al. | 200/144 B |
| 5,286,932 A | | 2/1994 | Rouch et al. | 200/144 B |
| 5,585,611 A | | 12/1996 | Harvey et al. | 218/155 |
| 5,589,675 A | | 12/1996 | Walters et al. | 218/140 |
| 5,597,992 A | | 1/1997 | Walker | 218/121 |
| 5,654,532 A | * | 8/1997 | Meyer et al. | 218/63 |
| 5,698,831 A | | 12/1997 | Abdelgawad et al. | 218/138 |
| 5,747,765 A | | 5/1998 | Bestel et al. | 218/155 |
| 5,767,451 A | | 6/1998 | Röhling et al. | 174/158 |
| 5,808,258 A | | 9/1998 | Luzzi | 218/136 |
| 5,864,108 A | | 1/1999 | Röhling et al. | 218/134 |
| 5,912,604 A | | 6/1999 | Harvey et al. | 335/9 |
| 5,917,167 A | | 6/1999 | Bestel | 218/138 |
| 6,046,422 A | | 4/2000 | Renz et al. | 218/134 |
| 6,130,394 A | | 10/2000 | Högl | 218/138 |
| 6,172,317 B1 | * | 1/2001 | Wristen | 218/139 |
| 6,198,062 B1 | * | 3/2001 | Mather et al. | 218/154 |
| 6,310,310 B1 | * | 10/2001 | Wristen | 218/139 |
| 6,506,990 B2 | * | 1/2003 | Marin-Pache et al. | 200/400 |

FOREIGN PATENT DOCUMENTS

| | | |
|---|---|---|
| EP | 0 152 444 A | 11/2001 |
| JP | 2000353460 | 12/2000 |

* cited by examiner

*Primary Examiner*—Lincoln Donovan
*Assistant Examiner*—M. Fishman
(74) *Attorney, Agent, or Firm*—Quarles & Brady LLP

(57) ABSTRACT

A circuit interrupter including a housing having an internal cavity. The internal cavity includes a space at a first end thereof, and includes an internal wall extending from the space to a second end of the housing. A vacuum interrupter is disposed in the space. The vacuum interrupter has at least one movable contact for contacting at least one stationary contact. An operating rod extends through the cavity, and is operable to move the moveable contact. At least one baffle is fixed to the operating rod, and disposed in the cavity. In a preferred embodiment, at least one step is formed in the wall. The step separates a first internal wall section from a second internal wall section, and the first internal wall section is closer to the space than the second internal wall section.

25 Claims, 5 Drawing Sheets

HIGH VOLTAGE INTERRUPTER

CROSS REFERENCES TO RELATED APPLICATIONS

Not Applicable

STATEMENT REGARDING FEDERALLY SPONSORED RESEARCH

Not Applicable

BACKGROUND OF THE INVENTION

The field of invention is electrical circuit interrupters, and more particularly to a dry high voltage circuit interrupter having an increased strike distance.

High voltage circuit interrupters are used to selectively interrupt the flow of electrical current through a circuit. As used herein, the term "high voltage" means a voltage greater than 1,000 volts. Two types of high voltage circuit are generally in use, dry high voltage circuit interrupter and wet high voltage circuit interrupters. The primary difference between the two high voltage circuit interrupters is that the wet type is filled with oil, or some other dielectric fluid, which can leak.

Dry high voltage circuit interrupters typically include a vacuum interrupter encapsulated in an epoxy housing mounted to a frame. The vacuum interrupter includes a pair of electrodes, one being stationary and the other movable between an open position and a closed position to open and close the circuit. The movable electrode is typically mounted on the end of an operating rod which moves the moveable electrode between the open and closed positions.

The operating rod typically extends from the vacuum interrupter to engage an actuating mechanism mounted in the frame. The operating rod is insulated from the electrode to prevent the operating rod from conducting high voltage electrically energy from the electrode to the frame.

The housing typically includes an internal cavity for supporting the vacuum interrupter and operating rod. The shape of the internal cavity must also be designed to prevent high voltage energy from bridging the gap between the vacuum interrupter and the frame. The high voltage energy can bridge the gap by "tracking" along the internal wall of the cavity formed in the housing, or by striking the frame directly through the cavity.

Tracking is a phenomena resulting from contamination or condensation forming on the internal cavity walls which allows electrical charges to creep along the surface of the internal cavity wall from a high potential at the vacuum interrupter to the frame which is at ground potential. Tracking can be minimized by increasing the distance the electrical charge must creep before reaching the frame. Typically, increasing the distance between the vacuum interrupter and the frame requires increasing the overall height of the circuit interrupter to increase the distance between the vacuum interrupter and the frame. Unfortunately, a larger, that is taller, circuit interrupter is not always desirable.

In one known dry high voltage circuit interrupter disclosed in U.S. Pat. No. 5,747,765, a vacuum interrupter is disposed in an upper end of an internal cavity formed in the housing. The housing is mounted to a frame, and the internal cavity is open to the frame. Convolutions formed in the internal wall of the cavity increases the length of the internal wall between the vacuum interrupter and the frame to minimize tracking.

Providing convolutions minimizes the problems associated with tracking and allows a shorter circuit interrupter. Unfortunately, the shorter circuit interrupter increases the chance for a direct strike between the vacuum interrupter and the frame because of the shorter physical distance between the two components. Accordingly, a need exists to minimize direct strikes between the vacuum interrupter and the frame.

BRIEF SUMMARY OF THE INVENTION

The present invention provides a circuit interrupter including a housing having an internal cavity. The internal cavity includes a space at a first end thereof, and includes an internal wall extending from the space to a second end of the housing. A vacuum interrupter is disposed in the space. The vacuum interrupter has at least one movable contact for contacting at least one stationary contact. An operating rod extends through the cavity, and is operable to move the moveable contact At least one baffle is fixed to the operating rod, and disposed in the cavity. In a preferred embodiment, at least one step is formed in the wall. The step separates a first internal wall section from a second internal wall section, and the first internal wall section is closer to the space than the second internal wall section.

A general objective of the present invention is to increase the through-air strike distance between the vacuum interrupter and frame without increasing the overall height of the circuit interrupter. This objective is accomplished by providing a baffle in the cavity formed in the housing which blocks the most direct through-air path inside the housing between the vacuum interrupter and the frame.

The foregoing and other objectives and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENTS

Figure 1:
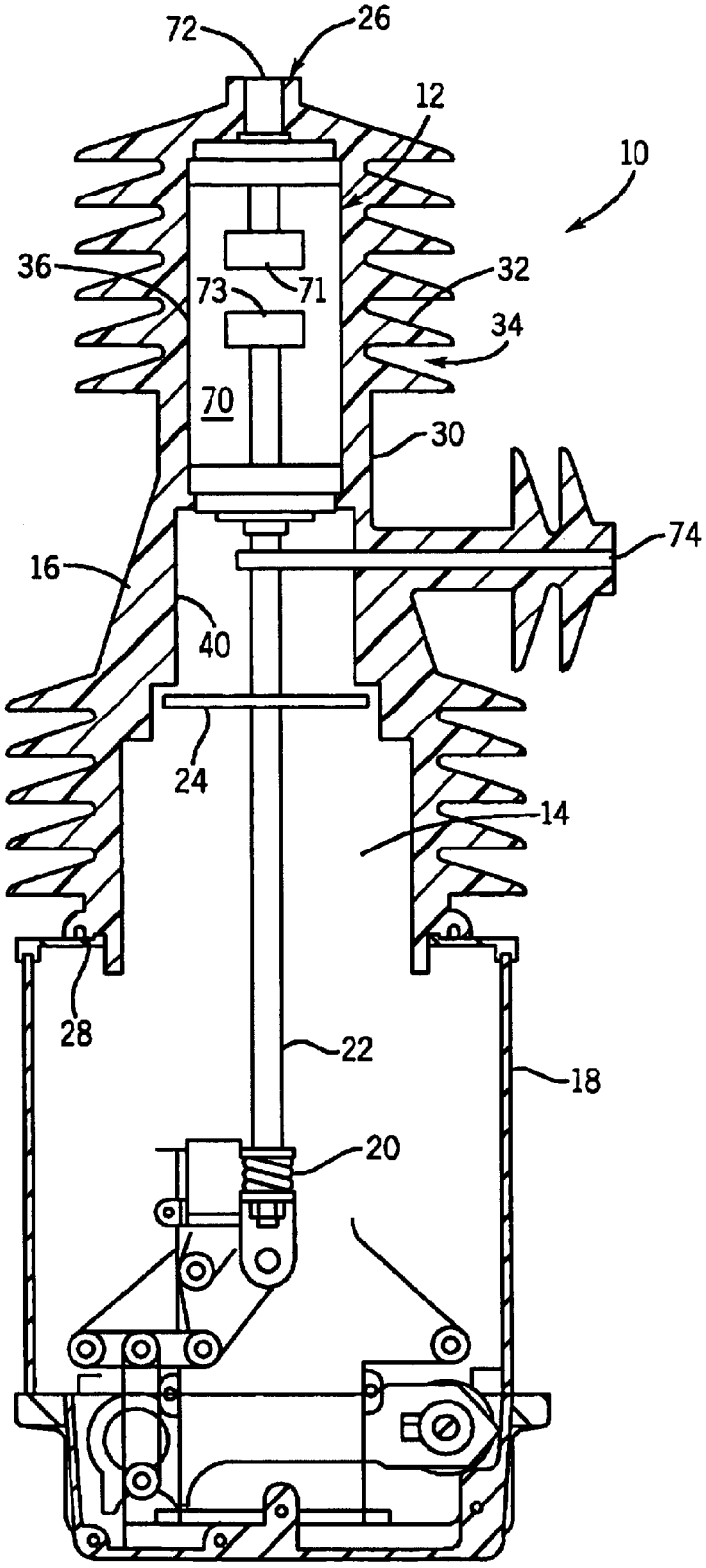
FIG. 1 is a cross sectional view of a high voltage circuit interrupter incorporating the present invention.
Figure 2:
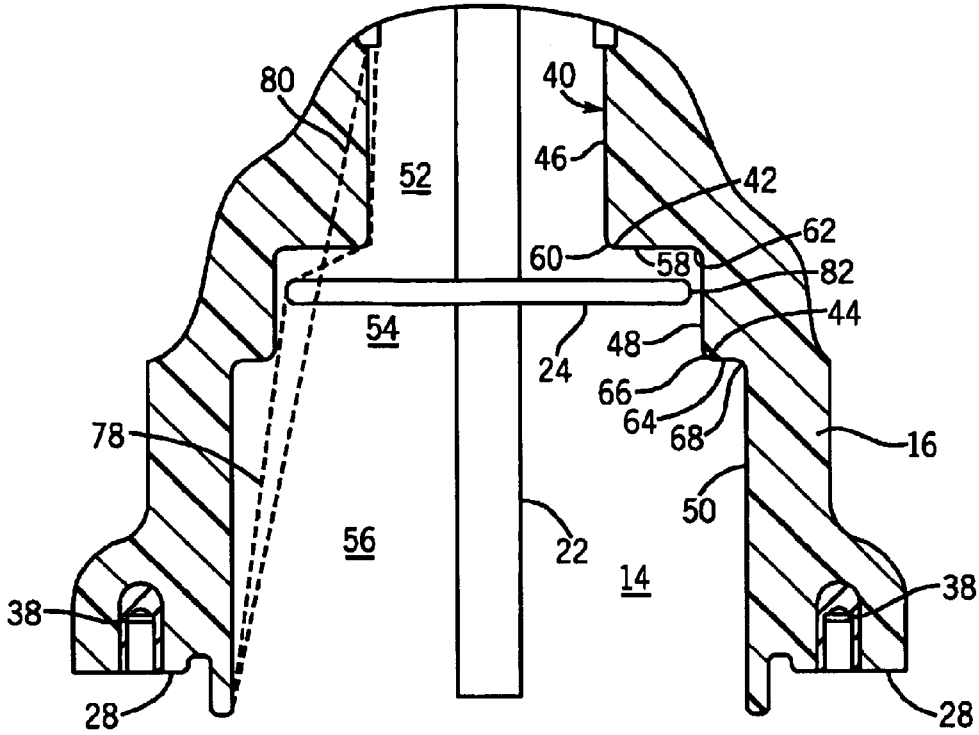
FIG. 2 is a detailed cross sectional view of the high voltage circuit interrupter of FIG. 1.

As shown in FIGS. 1 and 2, a dry high voltage circuit interrupter 10 includes a vacuum interrupter 12 disposed in an internal cavity 14 formed in a housing 16. The housing 16 is fixed to a base 18 having an operating mechanism 20 which axially drives an operating rod 22 to operate the vacuum interrupter 12. A baffle 24 fixed to the operating rod 22 increases the through-air strike distance between the vacuum interrupter 12 and the base 18.

The housing 16 is, preferably, formed from molded epoxy, and, has a top 26, bottom 28, and sides 30 joining the top 26 and bottom 28. As is known in the art, fins 32 extend radially from the housing sides 30 to increase the creep distance on the housing exterior surface 34. The internal cavity 14 formed in the housing 16 is, preferably, open to the housing bottom 28, and encapsulates the vacuum interrupter 12 in an internal cavity upper space 36. Threaded inserts 38 can be molded into the housing bottom 28 for fixing the housing 16 to the base 18 using bolts (not shown).

The internal cavity 14 has an inwardly facing internal wall 40 extending downwardly from the space 36 toward the base 18, and has a circular cross-section. Preferably, upper and lower steps 42, 44 formed in the internal wall 40 divides the internal wall 40 into three internal wall sections: an upper internal wall section 46, an intermediate internal wall section 48, and a lower internal wall section 50. Although an internal cavity 14 having a circular cross-section is disclosed, the cross section can be any shape, such as polygonal, elliptical, and the like without departing from the scope of the invention.

Each wall section 46, 48, 50 defines an internal cavity portion 52, 54, 56 having a different constant diameter. Preferably, the diameter of the cavity portion 52 defined by the upper internal wall section 46 is less than the diameter of the cavity portion 54 defined by the intermediate internal wall section 48 which is less than the diameter of the cavity portion 56 defined by the lower internal wall section 50. Of course, each cavity portion 52, 54, 56 can having a diameter which varies along the internal wall 40, such as to form a frustoconical shaped cavity portion without departing from the scope of the present invention.

The upper step 42 has a downwardly facing surface 58 formed in the internal wall 40 which divides the internal wall 40 into the upper internal wall section 46 and the intermediate internal wall section 48. The step 42 includes a radially inner edge 60 joined to the upper internal wall section 46 and a radially outer edge 62 joined to the intermediate wall internal wall section 48.

The lower step 44 also has a downwardly facing surface 64 formed in the internal wall 40 to separate the intermediate internal wall section 48 from the lower internal wall section 50. The step 44 includes a radially inner edge 66 joined to the intermediate internal wall section 48 and a radially outer edge 68 joined to the lower internal wall section 50. Although two steps are shown, one or more steps can be provided without departing from the scope of the present invention. Advantageously, each step 42, 44 increases the through-air distance and the distance an electrical charge must creep before reaching the base 18. In addition, although steps 42, 44 having a downwardly facing surface which is substantially perpendicular to the internal wall is shown, the downwardly facing surface can define an angle relative to the internal wall, such as by providing an angled internal wall, an angled surface, or both, without departing from the scope of the present invention.

The vacuum interrupter 12 is, preferably, encapsulated in the upper space 36 of the internal cavity 14, and includes a casing 70 which encloses a pair of electrodes 71, 73, one electrode 71 being stationary and the other electrode 73 movable between an open position and a closed position to open and close the circuit. A terminal 72 extending out of the housing top 26 is electrically connected to the stationary electrode, and another terminal 74 extending out of the housing side 30 is electrically connected to the moveable electrode. Any commercially available vacuum interrupter which can be encapsulated in the housing can be used without departing from the scope of the present invention.

The base 18 is fixed to the housing bottom 28, using methods known in the art, such as bolting, and houses the operating mechanism 20. The operating mechanism 20, can be any commercially available operating mechanism, which can axially drive an operating rod to operate the vacuum interrupter.

The operating rod 22 extends through the internal cavity 14, and is operatively connected to the operating mechanism 20 and the vacuum interrupter 12. The operating mechanism axially moves the operating rod 22 to move the moveable electrode relative to the stationary electrode in the vacuum interrupter 12 to selectively open or close the circuit, and thus interrupt the flow of electricity between the terminals 72, 74. Preferably, the operating rod 22 is formed from a dielectric material, such as an epoxy, and the like, so as not to conduct electricity between the vacuum interrupter 12 and the operating mechanism 20.

The baffle 24 is formed as an integral part of the operating rod 24 from the same type of material as the operating rod 24 to increase the through-air strike distance 78 of the dry high voltage circuit interrupter 10 over the straight line path 80 from the vacuum interrupter 12 to the base 18. Preferably, the baffle 24 is disc-shaped, and extends radially from the operating rod 22 toward the intermediate internal wall section 48. Most preferably, the radial outer edge 82 of the baffle 24 extends past the inner edge 60 of the upper step 42 to further increase the through-air strike distance 78 of the dry high voltage circuit interrupter 10. Although forming the baffle 24 as an integral part of the operating rod 22 is disclosed, the baffle 24 can be fixed to the operating rod 22, such as by adhesive bonding, interference fit, and the like, without departing from the scope of the invention.

Figure 3:
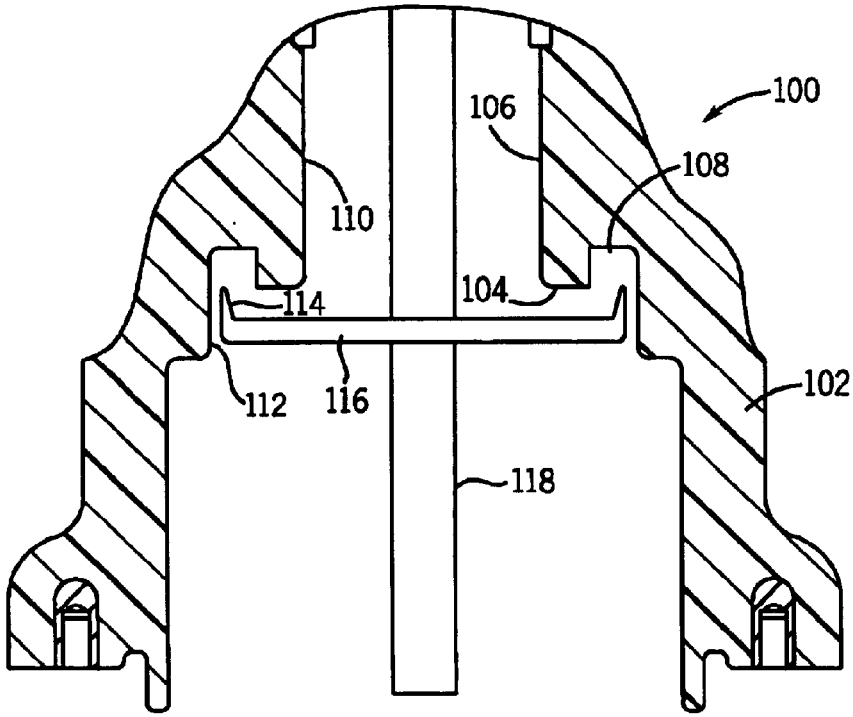
FIG. 3 is a detailed cross sectional view of an second embodiment of a high voltage circuit interrupter incorporating the invention.

In a second embodiment shown in FIG. 3, a dry high voltage circuit interrupter 100 has a housing 102 which includes a downwardly extending convolution 104 formed in a cavity internal wall 106. The convolution 104 forms a downwardly opening annular groove 108 between upper and intermediate internal wall sections 110, 112. A ring 114 extending upwardly from a baffle 116 fixed to an operating rod 118 is received in the groove 108 to further increase the through-air strike distance of the dry high voltage circuit interrupter 100 over the straight line path. Preferably, the ring 114 is formed as an integral part of the baffle 116 from the same material as the baffle 116. However, the ring 114 can be formed as a separate piece and fixed to the baffle 116 using methods known in the art, such as adhesive bonding, without departing from the scope of the present invention.

Figure 4:
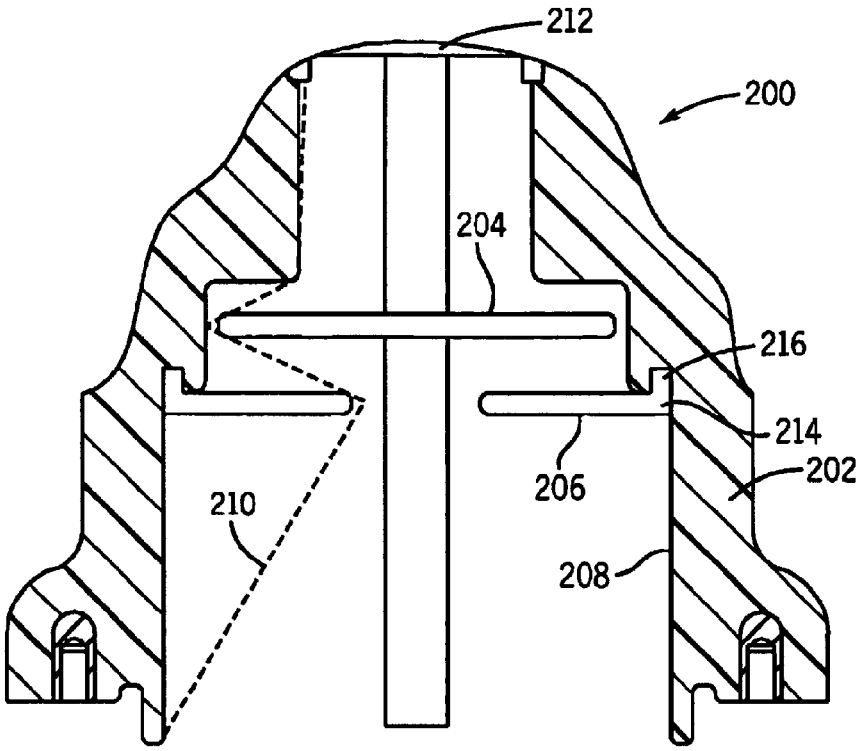
FIG. 4 is a detailed cross sectional view of an third embodiment of a high voltage circuit interrupter incorporating the invention.
Figure 5:
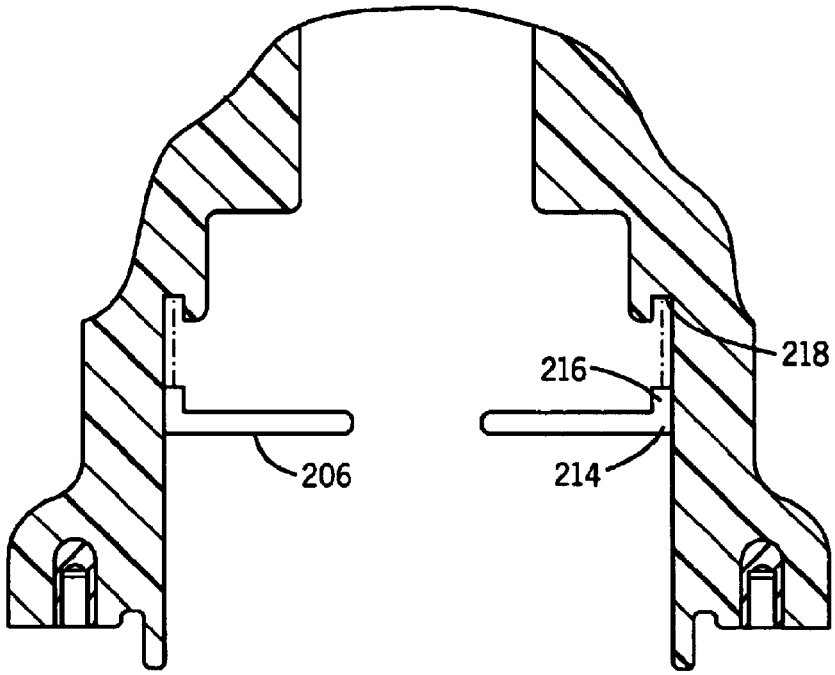
FIG. 5 is an exploded cross sectional view of the high voltage circuit interrupter of FIG. 4.

In a third embodiment shown in FIGS. 4 and 5, a dry high voltage circuit interrupter 200 has a housing 202 which includes a first baffle 204, such as disclosed in the first embodiment, and a second baffle 206 extending inwardly from a cavity internal wall 208. The second baffle 206 overlaps the first baffle 204 to further increase the through-air strike distance 210 of the dry high voltage circuit interrupter 200. Preferably, the first baffle 204 is interposed between a vacuum interrupter 212 and the second baffle 206 to simplify assembly. However, the second baffle 206 can be interposed between the vacuum interrupter 212 and the first baffle 204 without departing from the scope of the invention.

The second baffle 206 can be formed as an integral part of the internal wall 208, or formed as a separate part and be fixed to the wall 208. One method for fixing the second baffle 206 to the internal wall 208 is to bond an outwardly extending edge 214 of the second baffle 206 to the internal wall 208. A lip 216 extending upwardly from the second baffle outer edge 214 can be formed to provide a large bonding surface for adhesively bonding the second baffle 206 to the wall 208. Alternatively, the lip 216 can be received in a annular downwardly opening groove 218 formed in the internal wall 208 which is filled with an adhesive to bond the second baffle 206 to the internal wall 208.

Figure 6:
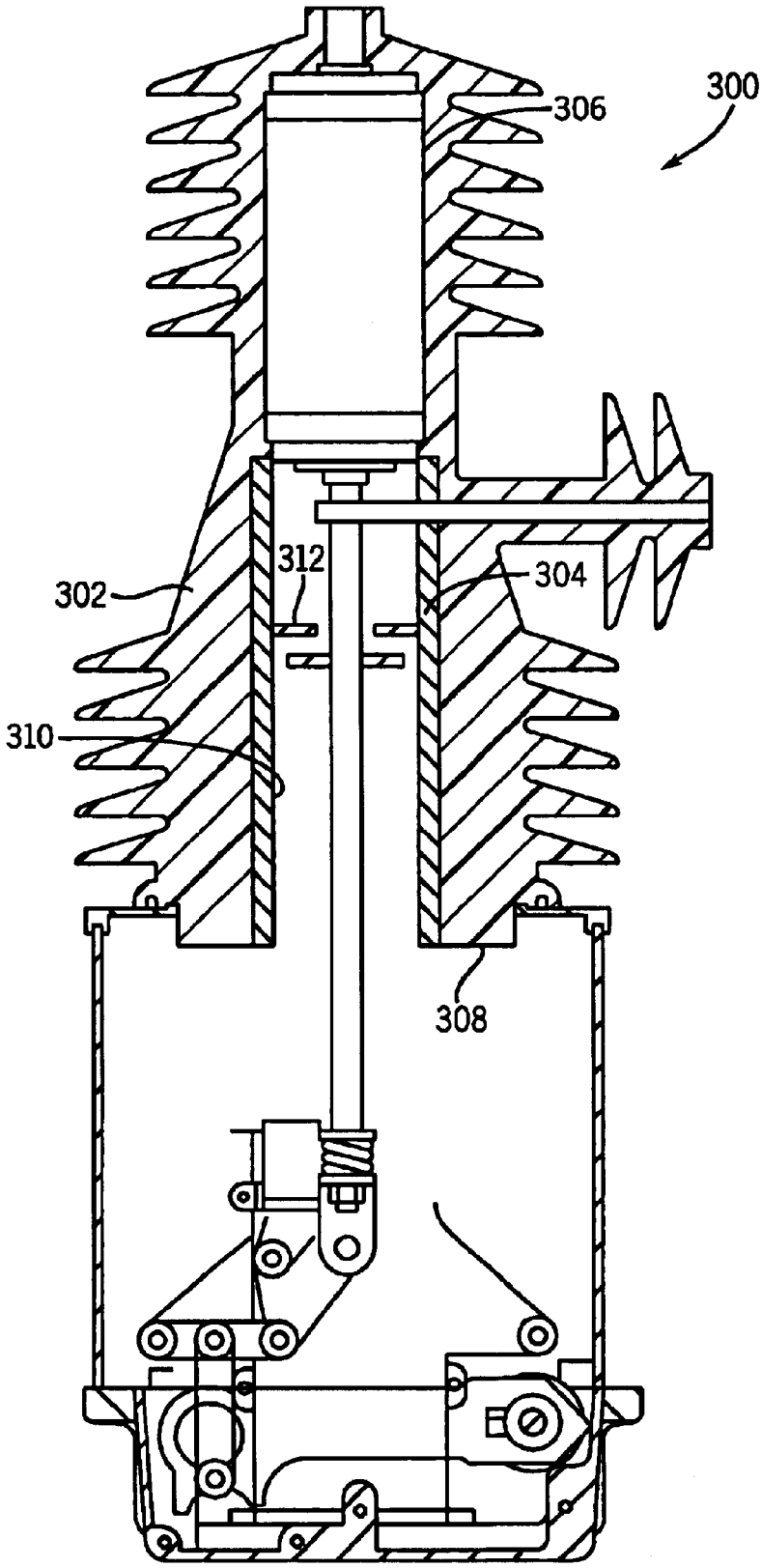
FIG. 6 is a cross sectional view of a fourth embodiment of a high voltage circuit interrupter incorporating the present invention.

Another method for providing a second baffle in the cavity includes a new method for forming the cavity in the housing. As shown in FIG. 6, a dry high voltage circuit interrupter 300 includes a housing 302 formed around a cylindrical insert 304 formed from a dielectric material, wherein the insert 304 extends from a vacuum interrupter 306 to a housing bottom 308. The insert 304 forms cavity internal wall 310, and includes a second baffle 312 extending inwardly and formed as an integral part of the internal wall 310. Of course, the insert 304 can include steps, convolutions, sections having different diameters, and comprise multiple parts to accommodate the terminal extending through the housing side or simplify assembly without departing from the scope of the present invention.

Figure 7:
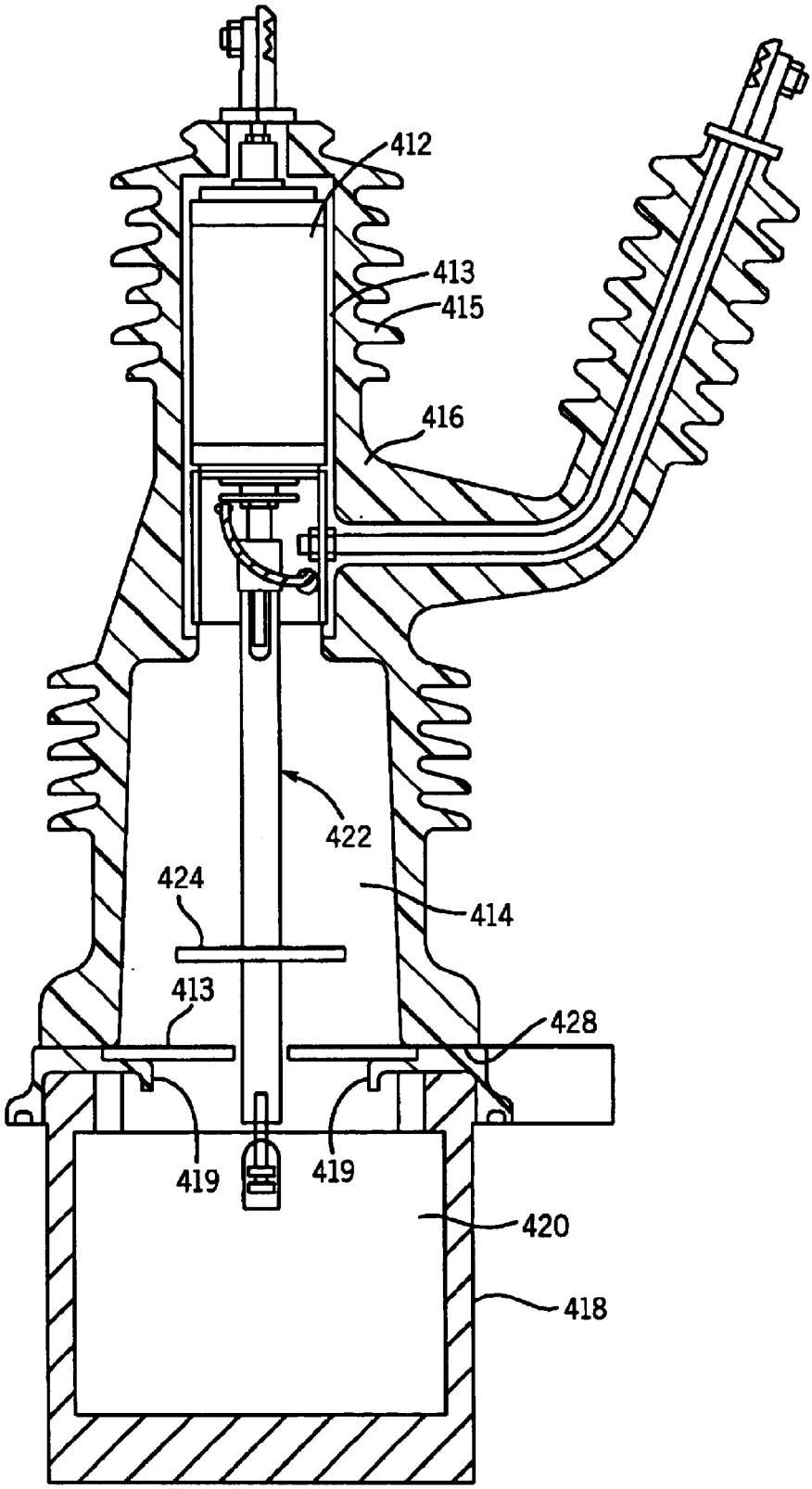
FIG. 7 is a cross sectional view of a fifth embodiment of a high voltage circuit interrupter incorporating the present invention.

In a preferred embodiment disclosed in FIG. 7, a housing 416 is formed from a first epoxy 413 which encapsulates a vacuum interrupter 412, and a second epoxy 415 which encapsulates the first epoxy and defines the internal cavity 414, as is known in the art. As described above in the first embodiment, the housing 416 is fixed to a base 418.

An operating rod 422 extends through the internal cavity 414, and is operatively connected to the vacuum interrupter 412 and an operating mechanism 420 disposed in the base 418. As in the above embodiments, the operating rod 422 is preferably formed from a dielectric material, or an assembly containing a dielectric material, so as not to conduct electricity between the vacuum interrupter 412 and the operating mechanism 420.

A baffle 424, such as disclosed in the above embodiments, is formed as an integral part of the operating rod 422 which overlaps with a second baffle 413 extending inwardly toward the operating rod 422. In this embodiment the second baffle 413 is a disc supported by the base 418 which simplifies assembly. Although a disc is disclosed, the second baffle can be any shape which provides a barrier between the vacuum interrupter 412 and the operating mechanism 420.

In this embodiment, the base 418 includes a lip 419 which supports the second baffle 413. Advantageously, the second baffle 413 is sandwiched between the base 418 and housing 416 to secure the second baffle 413 in place. As result, a means for attaching the second baffle 413 to the housing 416 or base 418 is not required. Although an attachment means is not required, means for attaching the second baffle 413 to the housing 416 and/or base 418 can be provided without departing from the scope of the invention. For example, the second baffle 413 can be attached to the housing bottom 428 using methods known in the art, such as adhesives, bolting, welding, and the like, and the lip 419 can be eliminated, such that the second baffle 413 is not supported by the base 418.

While there have been shown and described what is at present considered the preferred embodiments of the invention, it will be obvious to those skilled in the art that various changes and modifications can be made therein without departing from the scope of the invention defined by the appended claims. For example, the present invention is described with reference to a dry high voltage circuit interrupter, however, the invention can be incorporated into a wet high voltage circuit breaker without departing from the scope of the invention.

We claim:

1. A circuit interrupter comprising:

a housing having a first end and a second end, and including an internal cavity defined by an internal wall, said internal cavity including a space at said first end;

a vacuum interrupter disposed in said space, said vacuum interrupter having at least one movable contact for contacting at least one stationary contact;

a non-conductive operating rod extending through said cavity, and operable to move said at least one moveable contact; and at least one baffle fixed to said operating rod and disposed in said cavity, said baffle increasing the through-air strike distance between said vacuum interrupter and second end of said housing over a straight line path from said vacuum interrupter to said second end of said housing.

2. The circuit interrupter as in claim 1, including at least one step formed in said wall, said at least one step separating a first internal wall section from a second internal wall section, said first internal wall section being closer to said space than the second internal wall section.

3. The circuit interrupter as in claim 2, in which said baffle is disposed in a portion of said cavity defined by said second internal wall section.

4. The circuit interrupter as in claim 2, in which said step includes a downwardly facing surface.

5. The circuit interrupter as in claim 2, in which said step has an inner edge joined to said first internal wall section and an outer edge joined to said second internal wall section, and said baffle extends radially from said operating rod toward said second internal wall section past said step inner edge.

6. The circuit interrupter as in claim 1, in which said cavity is cylindrical.

7. The circuit interrupter as in claim 1, in which said housing is formed from molded epoxy.

8. The circuit interrupter as in claim 1, in which a second baffle overlapping said at least one baffle extends inwardly toward said operating rod.

9. The circuit interrupter as in claim 8, in which said second baffle extends inwardly from said internal wall towards said operating rod.

10. The circuit interrupter as in claim 8, in which said at least one baffle is interposed between said vacuum interrupter and said second baffle.

11. The circuit interrupter as in claim 8, in which said second baffle is an insert fixed to said internal wall.

12. The circuit interrupter as in claim 8, in which said second baffle is supported by a base fixed to said second end of said housing.

13. The circuit interrupter as in claim 8, in which said second baffle has a body with at least one tab extending outwardly from said base, wherein said tab is fixed to said internal wall and spaces said body from said internal wall.

14. The circuit interrupter as in claim 13, in which said tab is received in a slot formed in a second downwardly facing surface formed in said internal wall.

15. The circuit interrupter as in claim 1, including at least one downwardly extending convolution formed in said internal wall.

16. The circuit interrupter as in claim 15, in which an upwardly extending edge of said baffle is received in said convolution.

17. The circuit interrupter as in claim 15, in which an upwardly extending edge of a second baffle is received in said convolution, and said second baffle extends inwardly toward said operating rod.

18. A circuit interrupter comprising:

a housing having a first end and a second end, and including an internal cavity defined by an internal wall, said internal cavity including a space at said first end;

a vacuum interrupter disposed in said space, said vacuum interrupter having at least one movable contact for contacting at least one stationary contact;

at least one step formed in said wall, said at least one step separating a first internal wall section from a second internal wall section, said first internal wall section being closer to said space than the second internal wall section, said step having an inner edge joined to said first internal wall section and an outer edge joined to said second internal wall section;

a non-conductive operating rod extending through said cavity, and operable to move said at least one moveable contact; and at least one baffle fixed to said operating rod; and disposed in said cavity, said baffle extending radially from said operating rod toward said second internal wall section past said step inner edge, and increasing the through-air strike distance between said vacuum interrupter and said second end of said housing over a straight line path from said vacuum interrupter to said second end of said housing.

19. The circuit interrupter as in claim 18, in which said baffle is disposed in a portion of said cavity defined by said second internal wall section.

20. The circuit interrupter as in claim 18, in which said step includes a downwardly facing surface.

21. The circuit interrupter as in claim 18, in which a second baffle overlapping said at least one baffle extends inwardly toward said operating rod.

22. The circuit interrupter as in claim 21, in which said second baffle extends inwardly from said internal wall towards said operating rod.

23. The circuit interrupter as in claim 21, in which said at least one baffle is interposed between said vacuum interrupter and said second baffle.

24. The circuit interrupter as in claim 21, in which said second baffle is supported by a base fixed to said second end of said housing.

25. The circuit interrupter as in claim 18, including at least one downwardly extending convolution formed in said internal wall, and an upwardly extending edge of said baffle is received in said convolution.

* * * * *